US011097876B2

(12) United States Patent
Chalermwinsuekun

(10) Patent No.: US 11,097,876 B2
(45) Date of Patent: Aug. 24, 2021

(54) NON-SPILL DRINKING CONTAINER LID DEVICE

(71) Applicant: Rungkarn Chalermwinsuekun, Bangkok (TH)

(72) Inventor: Rungkarn Chalermwinsuekun, Bangkok (TH)

( * ) Notice: Subject to any disclaimer, the term of this patent is extended or adjusted under 35 U.S.C. 154(b) by 46 days.

(21) Appl. No.: 15/458,786

(22) Filed: Mar. 14, 2017

(65) Prior Publication Data

US 2018/0194524 A1 Jul. 12, 2018

Related U.S. Application Data

(60) Provisional application No. 62/443,688, filed on Jan. 7, 2017.

(51) Int. Cl.

| | |
|---|---|
| ***B65D 51/18*** | (2006.01) |
| ***B65D 43/02*** | (2006.01) |
| ***B65D 47/12*** | (2006.01) |
| ***A47G 23/02*** | (2006.01) |
| ***A47G 19/22*** | (2006.01) |

(52) U.S. Cl.

CPC ..... *B65D 51/18* (2013.01); *A47G 19/2272* (2013.01); *A47G 23/0233* (2013.01); *B65D 43/0231* (2013.01); *B65D 47/122* (2013.01); *B65D 2251/009* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01); *B65D 2543/00537* (2013.01)

(58) Field of Classification Search

CPC ... B65D 51/18; B65D 47/123; B65D 43/0231

See application file for complete search history.

(56) References Cited

U.S. PATENT DOCUMENTS

| | | | |
|---|---|---|---|
| 1,254,251 | A | 1/1918 | Magnus |
| 2,414,697 | A | 1/1947 | Pettersson |
| 2,534,614 | A | 12/1950 | Michael |
| 2,623,368 | A | 12/1952 | Olsen |
| 3,015,411 | A | 1/1962 | Smith |
| 3,208,629 | A | 9/1965 | Beeson |
| 3,338,467 | A | 8/1967 | Albert |
| 3,360,160 | A | 12/1967 | Spencer |
| 3,360,161 | A | 12/1967 | Smith |
| 3,549,044 | A | 12/1970 | Lerner |
| 3,727,808 | A | 4/1973 | Fitzgerald |

(Continued)

FOREIGN PATENT DOCUMENTS

GB 2482294 A 2/2012

OTHER PUBLICATIONS

European Search Report Application No. 18150379.8 dated Jun. 5, 2018.

*Primary Examiner* — Jeffrey R Allen

(57) ABSTRACT

A non-spill drinking container lid device comprising a collar, a sealing element, and a twist fastener that may be assembled and then attached as a lid device to a drinking container. When a person wants to drink from the container, suction by the mouth and compression by a person's lip causes the sealing element to separate from the collar and allow liquid to flow. The twist fastener provides for adding contents to the container without removing the sealing element or collar.

19 Claims, 12 Drawing Sheets

(56) References Cited

U.S. PATENT DOCUMENTS

| | | | | |
|---|---|---|---|---|
| 3,797,696 | A | 3/1974 | Dibrell | |
| 3,915,331 | A | 10/1975 | Chenault | |
| 3,938,695 | A | 2/1976 | Ruff | |
| 4,130,215 | A | 12/1978 | Corey et al. | |
| 4,184,603 | A | 1/1980 | Hamilton, Sr. | |
| 4,193,519 | A | 3/1980 | Dubach et al. | |
| 4,238,045 | A | 12/1980 | D'Andria | |
| 4,460,101 | A | 7/1984 | Tseng | |
| 5,249,703 | A | 10/1993 | Karp | |
| 5,370,258 | A | 12/1994 | Fair | |
| 5,540,350 | A | 7/1996 | Lansky | |
| 5,890,619 | A | 4/1999 | Belanger | |
| 5,979,689 | A | 11/1999 | Lansky | |
| 6,102,244 | A | 8/2000 | Kuwano et al. | |
| 6,102,245 | A | 8/2000 | Haberman | |
| 6,116,457 | A | 9/2000 | Haberman | |
| 6,176,399 | B1 | 1/2001 | Schantz et al. | |
| 6,202,877 | B1 | 3/2001 | La Torre et al. | |
| 6,325,236 | B1 | 12/2001 | Wong | |
| 6,488,170 | B1 | 12/2002 | Johnson | |
| 6,640,992 | B1 | 11/2003 | Berger et al. | |
| 6,659,302 | B2 | 12/2003 | Lin | |
| 6,702,145 | B2 | 3/2004 | Malcolm | |
| 6,745,915 | B2 | 6/2004 | Rees | |
| 7,100,790 | B2 | 9/2006 | Dark | |
| 7,168,589 | B2 | 1/2007 | Dark | |
| 7,549,556 | B2 | 6/2009 | Miller | |
| 7,575,126 | B2 | 8/2009 | Kemper | |
| 7,712,622 | B2 | 5/2010 | Ruccolo | |
| 8,025,178 | B2 | 9/2011 | Miller | |
| 8,033,420 | B2 | 10/2011 | Roseblade et al. | |
| 8,191,728 | B2 | 6/2012 | Auer et al. | |
| 8,272,525 | B1 | 9/2012 | La Torre et al. | |
| 8,333,299 | B2 | 12/2012 | Kemper et al. | |
| 8,453,870 | B2 * | 6/2013 | Berg | A47G 19/2272 215/311 |
| 9,033,167 | B1 * | 5/2015 | Pineda | A61J 9/00 137/537 |
| D741,658 | S | 10/2015 | Dunn et al. | |
| 9,149,138 | B2 * | 10/2015 | Miller | A47G 19/22 |
| D744,281 | S | 12/2015 | Dunn et al. | |
| 9,215,942 | B2 | 12/2015 | Bodum | |
| 9,241,588 | B2 | 1/2016 | Dunn et al. | |
| 9,801,481 | B2 | 10/2017 | Dunn et al. | |
| 9,888,796 | B2 | 2/2018 | Dunn et al. | |
| 2005/0224495 | A1 | 10/2005 | Kartinian | |
| 2009/0139950 | A1 | 6/2009 | Greter et al. | |

* cited by examiner 10
14
16
18
20
22
26
28
30
32
36
42
44
46
48
50
52
54
58
60
62
64
66
68
70
72
74
76

18
26
90
68
20

18
94
26
20
68
92

98
18
68
90
96

18
26
68
92
20

18
68
26
20

18
20
90
68
96
26

18
92
94
26
20

18
94
92
26

NON-SPILL DRINKING CONTAINER LID DEVICE

RELATED APPLICATION

This application claims the benefit of U.S. Provisional Patent Application No. 62/443,688 filed Jan. 7, 2017 entitled NON-SPILL DRINKING CONTAINER LID DEVICE which is hereby incorporated herein by reference in its entirety.

FIELD OF THE INVENTION

This invention is related to a non-spill drinking container lid device comprising a collar, a sealing element, and a twist fastener that may be assembled and then attached as a lid device to a drinking container. When a person wants to drink from the container, suction by the mouth and compression by a person's lip causes the sealing element to separate from the collar and allow liquid to flow. The twist fastener provides for adding contents to the container without removing the sealing element or collar.

BACKGROUND OF THE INVENTION

Non-spill drinking containers are important in early childhood development to transition a child away from a bottle to a cup. During this transition a child is comfortable and adept at sucking to receive fluid from a container rather than tipping an open container and capturing fluid in their mouths. Various covers that seal and prevent spillage are known although most include somewhat complex valve elements and spouts that may not reliably seal or may be difficult to clean and therefore non-hygienic particularly for a toddler or young child that is very susceptible to germs. Non-spill drinking containers may also be used for adults in motion and carrying for example coffee or another drink or for elderly persons or others with limited mobility and dexterity to hold and maneuver a container without spilling its contents.

One example is a drinking cup to Berg, U.S. Pat. No. 8,453,870 that has a container and a conical shaped valve element that has a series of indentations and a fastening opening in its center to receive a conical shaped gasket. The conical shaped gasket has a fastening groove along its protruding mid-section that is received in the fastening opening of the valve element to grip and secure the gasket to the valve element. The protruding mid-section provides for the gasket to be pulled using sufficient force out of the fastening opening and be removed for cleaning. The gasket seals along the rim of the valve element and opens when suction is applied by the mouth of a person to drink from the container. The gasket as disclosed by Berg is made from an elastic, rubberlike material such that by grasping and pulling on the gasket, deformation occurs and because the gasket must be repeatedly removed and cleaned, repeated deformation may permanently misshapen the gasket so that it will not lay flat against the rim and therefore will no longer seal.

In a non-spill container to Dunn et al., U.S. Pat. No. 9,241,588, a protrusion extends upwards from a collar for attachment of a gasket or seal. The gasket has an opening so that it may be pressed over the protrusion and be secured to the collar that is attached to the drinking container. The gasket must still be similarly pulled or pushed off of the protrusion for cleaning also causing deformation and possible tears in the seal which may result in failure of the seal and leaking from the container. In the present invention, the sealing element is seated within the collar and the twist fastener is attached to the collar to secure the seal, so that the sealing element is not deformed when removing.

In another drinking vessel to Miller, U.S. Pat. No. 9,149,138 a cylindrical sealing element having a series of channels for fluid flow is disclosed. An outer flange of the sealing element abuts the rim of an outer member or collar. The outer member is attached to a container and comprises a cylindrical inner portion that has a number of radial extensions which define a series of apertures. The series of channels in the sealing element communicate with the series of apertures to provide fluid flow from the container. The sealing element has an inner flange that is pulled up and around an inner member to set the inner flange in a groove of the inner member to secure the sealing element to the inner member. The inner member is secured to the outer member with a series of flexible teeth that permits a snap fit attachment of the inner member to the outer member aligning the sealing element therebetween. By providing a series of fluid flow channels in the sealing element, dirt and germs may be trapped along internal surfaces making the necessary cleaning of the sealing element difficult and a hygienic risk to small children using the drinking vessel. In the present invention, surfaces of the seal are exposed for more effective cleaning and the twist fastener is provided to easily secure the sealing element in place and remove the sealing element without deformation or exceptional force in prying or pulling a gasket or sealing element or in prying apart a snap-fit attachment of pieces.

Importantly, in each of these drinking containers and lid devices of the prior art, the gasket or sealing element only provides fluid flow from the container by applying suction to the rim of the container to deform the sealing element and separate it from the rim. Compressing the gasket or sealing element of these lid devices along the rim using the lip will not or will very minimally separate the gasket or sealing element from the rim. Very differently in the present invention, fluid flow from the container is provided by applying suction and fluid flow is increased by compressing the sealing element using the lip, so that as desired a wider opening for fluid flow between the sealing element and collar, with less exertion of energy by a person in applying suction, is provided than the fluid flow paths provided only by suction in the lid devices of the prior art. While there are some lid devices of the prior art that may be compressed to allow fluid flow, these devices require a spring, hinge, or valve to reseat the lid and prevent fluid flow after the lid device has been compressed. The unique shape and a transition in thickness of the sealing element of the present invention provides for a wide opening and resealing of the lid device without the requirement of a spring, hinge or valve to reseat and seal the container.

SUMMARY OF THE INVENTION

The present invention is related to a lid device that comprises a collar, a sealing element, and a twist fastener that may be assembled and attached as a non-spill lid for a drinking container. The sealing element rests against the rim of the collar so that when suction by mouth is applied at the rim the seal deforms and separates from the rim providing for liquid to flow from the container. To widen the fluid flow path and provide more liquid, a person may compress the sealing element with their lip thereby widening the opening with less exertion of energy by a person in applying suction to drink from the container. The lid device of the present invention provides for a person to drink from any portion along the rim of the lid, so that particularly for a small child, the orientation of the container does not need to be changed for the person to drink. The sealing element is secured to the collar using a twist fastener that is inserted through an opening in the sealing element and attached to a threaded opening in the collar. The attachment of the sealing element using a twist fastener makes the lid device spill proof by sealing completely even when the drinking container is tipped or shaken. The twist fastener also facilitates adding contents to the container by turning and removing the twist fastener and pouring contents through the opening without unseating or removing the sealing element reducing or preventing damage to the sealing element. The sealing element is made from a soft, elastic, durable material, such as silicone that is safe and non-toxic.

The sealing element has a sealing surface along its lower surface that is seated within a recess of the collar. A series of apertures in the base of the collar provide fluid communication with the container. The sealing surface of the sealing element is formed with teeth or castellations that create flow paths to provide fluid flow from the container when suction is applied at the rim of the collar. When suction is not applied, the short distances between the castellations form capillary seals trapping fluid between each cube shaped castellation sealing the fluid flow paths. In applying suction, fluid is drawn out of each capillary seal. Fluid flow from the container may be increased by compressing a person's lip against the sealing element that because of its unique shape causes greater deformation of the sealing element to widen the gap between the outer edge of the seal and the rim of the collar. The rim of the collar has a curved surface with protrusions along its interior wall that create flow channels between an upper conical portion of the seal and a conical flange formed along the outer edge of the sealing element. The conical flange is of a thinner dimension and angled to more easily deform when suction is applied and when compressed by the lip of a person. The curved rim surface of the collar extends to an outer cylindrical wall having threads for attachment to a drinking container. The diameter of the collar and dimension of the threads may be in standard sizes for attachment to standard containers of various volumes and shapes so that the lid device may be used for children's non-spill drinking cups, in travel mugs, or in other types of containers. The lid device is easily disassembled and the surfaces of each of the components are exposed for easy cleaning.

An object and advantage of the invention is a lid device that may be easily assembled and then be attached to a container to provide a non-spill seal to the container even when tipped or shaken.

An object and advantage of the invention is to provide lid device having a sealing element that easily deforms when suction is applied by mouth to allow liquid to flow from a container.

An object and advantage of the invention is a flexible sealing element that when compressed by the lip of a person provides a much wider opening for fluid flow compared to the lid devices of the prior art.

An object and advantage of the invention is a sealing element having a transition point where an outer conical portion is angled downwards from an upper conical portion so that when the sealing element is compressed by the lip of a person at or near the transition point the sealing element is separated from the collar to form a much wider opening for fluid flow compared to the lid devices of the prior art.

An object and advantage of the invention is a sealing element having a thicker dimensioned upper conical portion that transitions to an outer conical flange that is reduced in thickness so that when the sealing element is compressed by the lip of a person a much wider opening for fluid flow as compared to the lid devices of the prior art is formed.

An object and advantage of the invention is to provide a lid device that allows a person to drink from any portion along the sealing element of the lid device.

An object and advantage of the invention is to provide a lid device in standard sizes that may be used to seal various types of containers.

An object and advantage of the invention is to provide a twist fastener that when tightened secures the sealing element and creates a non-spill seal for a drinking container.

An object and advantage of the invention is to provide a twist fastener having a knob, grip, or tab that may be easily grasped between the fingers and be turned.

An object and advantage of the invention is to provide for contents to be added to the container by removing the twist fastener without requiring the removal of the sealing element or collar of the lid device from the container.

An object and advantage of the invention is to provide a lid device with components that have exposed surfaces for easy cleaning.

An object and advantage of the invention is to provide a sealing element with smooth exposed surfaces that may be easily cleaned.

An object and advantage of the invention is to provide a lid device having a collar, sealing element and twist fastener that are made from safe, non-toxic materials.

An object and advantage of the invention is the placement and removal of the sealing element without deformation.

An object and advantage of the invention is to provide a lid device having a collar with a curved rim with protrusions along its interior surface.

An object and advantage of the invention is to provide a lid device having a collar with a recess to seat the sealing element, the recess provided with a series of openings to provide for fluid flow from the container.

An object and advantage of the invention is to form the recess in the collar between an interior wall that forms the opening in the collar and a cylindrical ridge that extends up from the base of an interior cylinder of the collar.

An object and advantage of the invention is to provide a sealing element having a lower sealing surface configured to be seated within the recess of the collar, a cylindrical mid-section, and an upper conical portion that extends to a conical flange.

An object and advantage of the invention is to provide a sealing element having a conical flange having a thinner dimension to more easily deform when suction is applied.

An object and advantage of the invention is the formation of a conical flange along the outer edge of the sealing element, the conical flange formed from thinner material than the upper conical portion and providing for greater deformation along the flange to more easily deform when suction is applied by mouth and to have the sealing element be compressed to widen the opening for fluid flow thereby more easily providing flow from a container with less exertion of energy by a person.

An object and advantage of the invention is to provide a sealing element having castellations that form fluid flow paths at the sealing surface that is seated within the recess of the collar, the small dimensions of the castellations and short distances between each castellation form capillary seals trapping fluid between each cube shaped castellation when suction is not applied sealing the fluid flow paths.

An object and advantage of the invention is to provide a sealing element having castellations formed along an outer sidewall of the sealing surface.

An object and advantage of the invention is to provide a sealing element having castellations configured to be seated on a ridge formed in the recess in the collar, the flow paths of the castellations extending over the ridge to provide fluid flow from the container when suction is applied to the rim of the lid device.

An object and advantage of the invention is to provide a collar with a cylindrical interior section having protrusions to align with the cylindrical mid-section of the sealing element forming fluid flow channels.

An object and advantage of the invention is to provide a non-spill lid device that is easily disassembled for cleaning.

The present invention is related to a non-spill lid device for a drinking container, comprising a collar; a sealing element; and a twist fastener configured for attachment to the collar to secure the sealing element; the lid device configured to seal a drinking container and prevent spills even when tipped or shaken. In some embodiments of the non-spill lid device for a drinking container, the collar has a standard diameter and standard sized threads configured for attachment of the lid device to standard sized drinking containers of various types. In some embodiments of the non-spill lid device for a drinking container, the twist fastener may have a knob, grip, or tab that may be easily grasped between the fingers and be turned. In some embodiments, the twist fastener is configured to be inserted through an opening in the sealing element and an opening in the collar providing for the twist fastener to be removed to add contents to a container without removing the sealing element or collar or deforming the sealing element or collar of the lid device from the container. The collar, sealing element, and twist fastener of the lid device are made from safe, non-toxic materials and have exposed surfaces for easy cleaning.

In some embodiments of the non-spill lid device for a drinking container, the collar and twist fastener are configured for placement and removal of the sealing element without deformation to the sealing element. In some embodiments of the non-spill lid device for a drinking container, the collar comprises a first cylindrical wall forming an opening in the collar and configured for attachment of the twist fastener, a second cylindrical wall having a base extending to the first cylindrical wall forming a cylinder having a recess along the base between the first cylindrical wall and the second cylindrical wall, the base having a plurality of apertures for fluid flow from the container. In some embodiments, the collar further comprises a third cylindrical wall offset from the cylinder by a shelf formed between the second cylindrical wall and the third cylindrical wall, the third cylindrical wall curving outward to form a rim, the rim having protrusions forming fluid flow channels. In some embodiments, the collar comprises a cylindrical ridge extending from the base.

In some embodiments of the non-spill lid device for a drinking container, the sealing element has an outer sealing surface along its lower surface configured to be seated within the recess of the collar. In some embodiments, the sealing element has castellations forming fluid flow paths at the outer sealing surface, the castellations configured to form capillary seals trapping fluid between each castellation when suction is not applied sealing the fluid flow paths. In some embodiments, the castellations are configured to be seated across the ridge formed in the base of the collar, the fluid flow paths of the castellations extending over the ridge to provide fluid flow from the container when suction is applied to the rim of the lid device. In some embodiments, the castellations are formed along an outer sidewall of the outer sealing surface.

In embodiments of the non-spill lid device for a drinking container the sealing element comprises a bottom portion, a cylindrical mid-section extending from the bottom portion and an upper conical portion extending from the cylindrical mid-section and a conical flange extending downwards at an angle from the upper conical portion, the downwards angle forming a transition point between the upper conical portion and the conical flange, and thereby the conical flange is configured to flex, deform and separate from the collar when a lip compresses at or near the transition point thereby providing more fluid flow from a container with less exertion of energy by a person. In some embodiments, the sealing element of the non-spill lid device for a drinking container having a first thickness and the conical flange having a second thickness thinner than the first thickness, the conical flange configured to flex and separate from the collar when suction is applied thereby providing more fluid flow from a container. In some embodiments of the non-spill lid device for a drinking container, the collar has a cylindrical interior section configured to align with a cylindrical mid-section of the sealing element, the cylindrical interior section of the collar having protrusions forming fluid flow channels.

The present invention is also related to a method of sealing a drinking container, comprising forming a lid device having a collar, a sealing element and a twist fastener; attaching the twist fastener to the collar to secure the sealing element. In some embodiments, the method of sealing a drinking container may comprise forming a recess in the collar, the recess having a cylindrical ridge; forming the sealing element with an outer sealing surface, the outer sealing surface having castellations that form fluid flow paths; seating the sealing element within the recess with the castellations configured to be seated across the ridge thereby providing for fluid flow when suction is applied and forming capillary seals of the fluid flow paths when suction is not applied.

The present invention is further related to a non-spill lid device for a drinking container, comprising a collar; a sealing element having a conical flange angled downwards from an upper conical portion forming a transition point and wherein the conical flange configured to flex and separate the sealing element from the collar when the sealing element is compressed at or near the transition point by the lip, the sealing element having castellations forming fluid flow paths at an outer sealing surface, the castellations configured to form capillary seals trapping fluid between each castellation when suction is not applied sealing the fluid flow paths and configured to form fluid flow paths through the castellations when suction is applied; and a twist fastener having a grip and configured for attachment to the collar to secure the sealing element; the collar and twist fastener configured for placement and removal of the sealing element without deformation to the sealing element; and the collar, sealing element and twist fastener forming a lid device configured to seal a drinking container and prevent spills even when tipped or shaken and to provide more fluid flow from a container when suction is applied by mouth and compression is applied by the lip.

The present invention is further related to an attachment apparatus for a lid device for a drinking container, comprising a twist fastener configured to attach a lid device to seal a drinking container and prevent spills even when tipped or shaken.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

Throughout the following description, identical reference numerals will be used to identify like parts.

DETAILED DESCRIPTION OF THE INVENTION

Figure 1B:
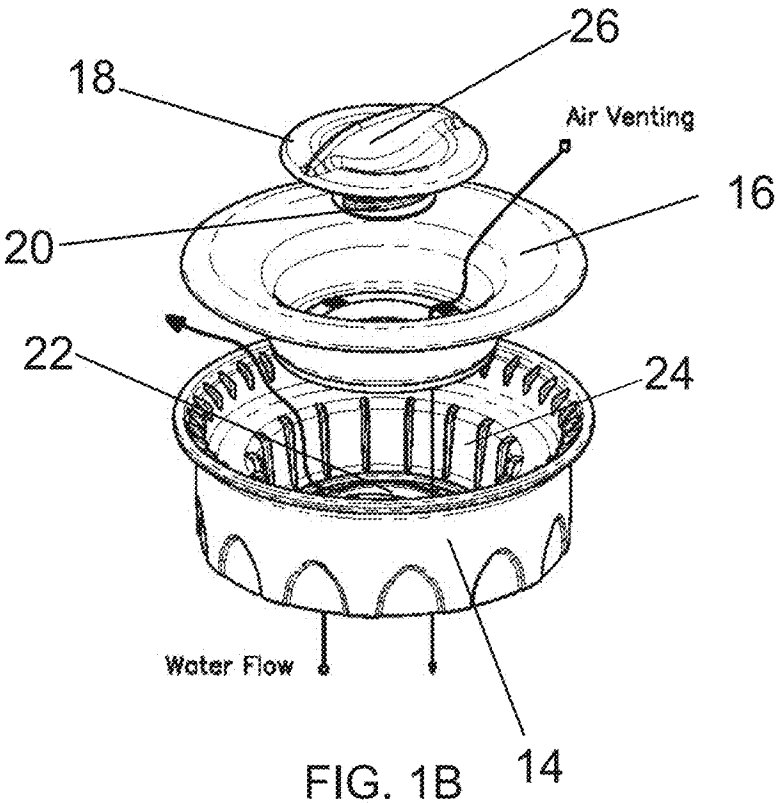
FIG. 1B is an exploded view of an embodiment of the components of the lid device of the present invention.
Figure 1A:
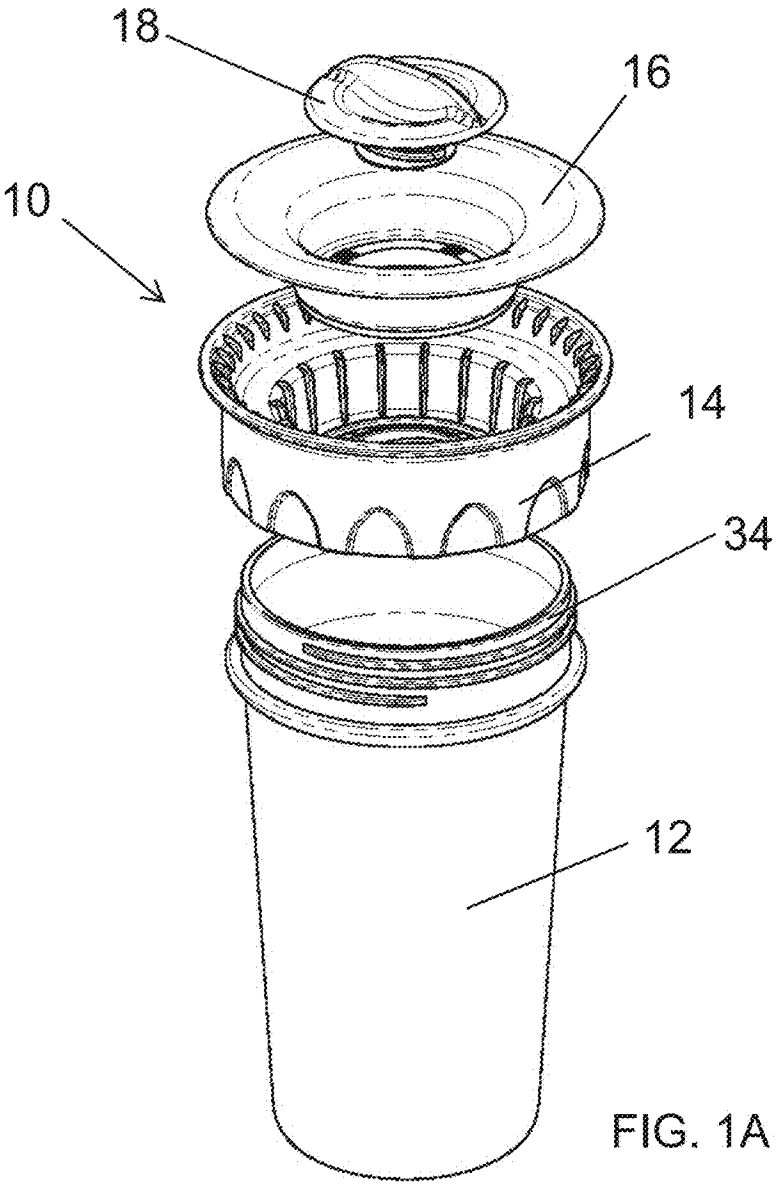
FIG. 1A is an exploded view of an embodiment of the components of the lid device of the present invention with a container.

An embodiment of the non-spill lid device 10 of the present invention is shown in an exploded view with a container 12 in FIG. 1A. The lid device 10 comprises a collar 14 configured for attachment to the container 12, a sealing element 16 configured to be seated within the collar 14 and a twist fastener 18 configured for attachment to the collar 14 to secure the sealing element 16 within the collar 14. The components of the lid device 10 may be assembled by placing the sealing element 16 within the collar 14 and inserting the threaded body 20 of the twist fastener 18 through an opening formed in the base 22 of an interior cylinder 24 of the collar 14 and turning the knob, grip or tab 26 of the twist fastener 18 to attach the sealing element 16 to the collar 14, as shown in FIG. 1B. The lid device 10 provides for fluid such as water to flow through the collar 14, between the collar 14 and sealing element 16 and out along the edge of the collar 14. Air venting may be provided through the sealing element 16 to assist in fluid flow. As shown in a bottom view of the assembled lid device 10 in FIG. 2A, the interior cylinder 24 is within and offset from an outer cylindrical wall 28 of the collar 14 and a series of threads 30 are formed in the interior surface 32 of the cylindrical wall 28 to attach the collar 14 to a container 12 having exterior threads 34 as shown in FIG. 1A. In alternative embodiments of the lid device 10, the collar 14 may have exterior threads 30 along a lower portion of the outer cylindrical wall 28 to attach the lid device 10 to a container having interior threads. The outer cylindrical walls 28 may have grips, indentations or other surface texture 36 to provide for a person to more easily grab or hold the container by the lid device 10. A series of apertures 38 is formed through the base 22 of the interior cylinder 24 of the collar 14 to provide fluid passageways between the container 12 and lid device 10.

Figure 2C:
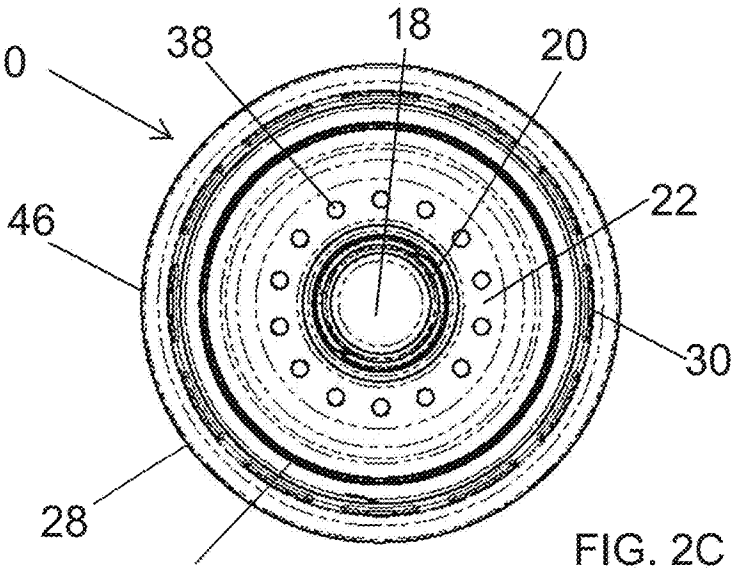
FIG. 2C is a bottom view of an embodiment of the assembled components of the lid device of the present invention.
Figure 2A:
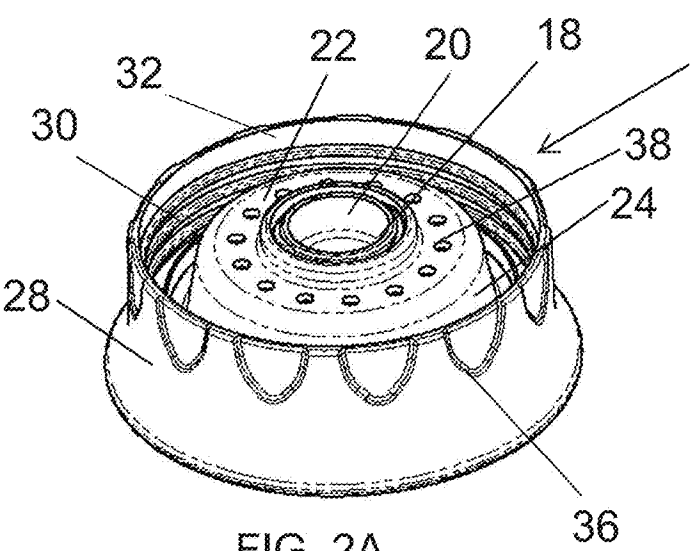
FIG. 2A is a bottom perspective view of an embodiment of the assembled components of the lid device of the present invention.
Figure 2D:
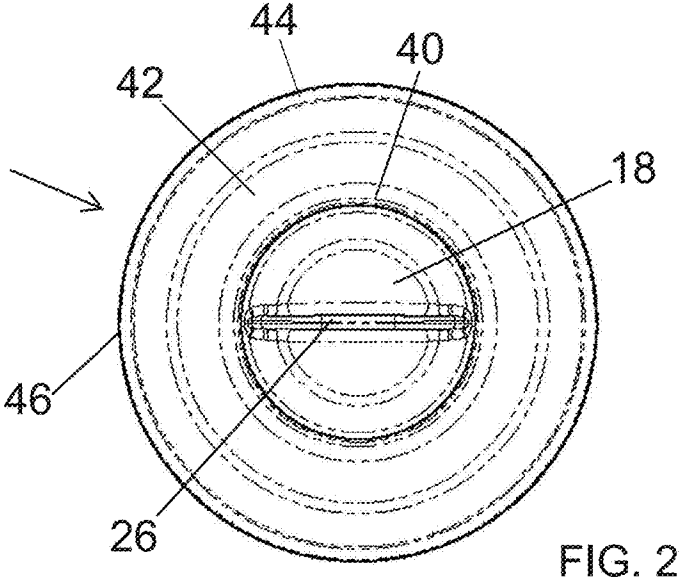
FIG. 2D is a top view of an embodiment of the assembled components of the lid device of the present invention.
Figure 2B:
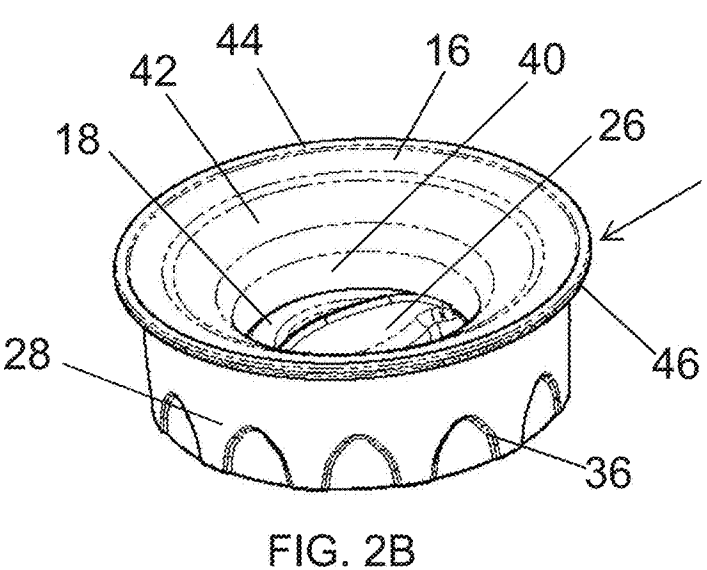
FIG. 2B is a top perspective view of an embodiment of the assembled components of the lid device of the present invention.

As shown in a top view in FIG. 2B, once assembled the sealing element 16 is seated within the collar 14 with a cylindrical mid-section 40 of the sealing element 16 aligned within the interior cylinder 24. An upper conical portion 42 smoothly transitions from the mid-section 40 to a conical flange 44 that rests along the rim 46 of the collar 14. The twist fastener 18 is positioned within the interior cylinder 24 of the collar 14 with the mid-section 40 of sealing element 16 surrounding the twist fastener 18. The tab 26 is accessible to tighten and secure the sealing element 16 or loosen to remove and clean or replace the sealing element 16. The twist fastener 18 may also be removed to provide for contents to be poured through the opening in the interior cylinder 24 and into the container 12 without removal of the collar 14 or sealing element 16 preventing damage or deformation to the sealing element 16.

The conical flange 44 of the sealing element 16 may sit within the rim 46 to provide for the interior surface of the flange 44 to lay flat against the rim 46 until suction is applied or the sealing element 16 is compressed as described herein. As shown in FIG. 2C, in a bottom view of the lid device 10, the body 20 of the twist fastener 18 is threaded into the opening in the collar 14 and the base 22 of the interior cylinder 24 is flat with a series of apertures 38. The cylinder 24 is separated from the threads 30 along the interior surface 32 of the outer wall 28 of the collar 14. In a top view of this embodiment as shown in FIG. 2D, the mid-section 40 of the sealing element 16 surrounds the twist fastener 18 and tab 26, the upper conical portion 42 transitions smoothly from the mid-section 40, and the rim 46 of the collar 14 surrounds the conical flange 44.

Figures 2E, 2F:
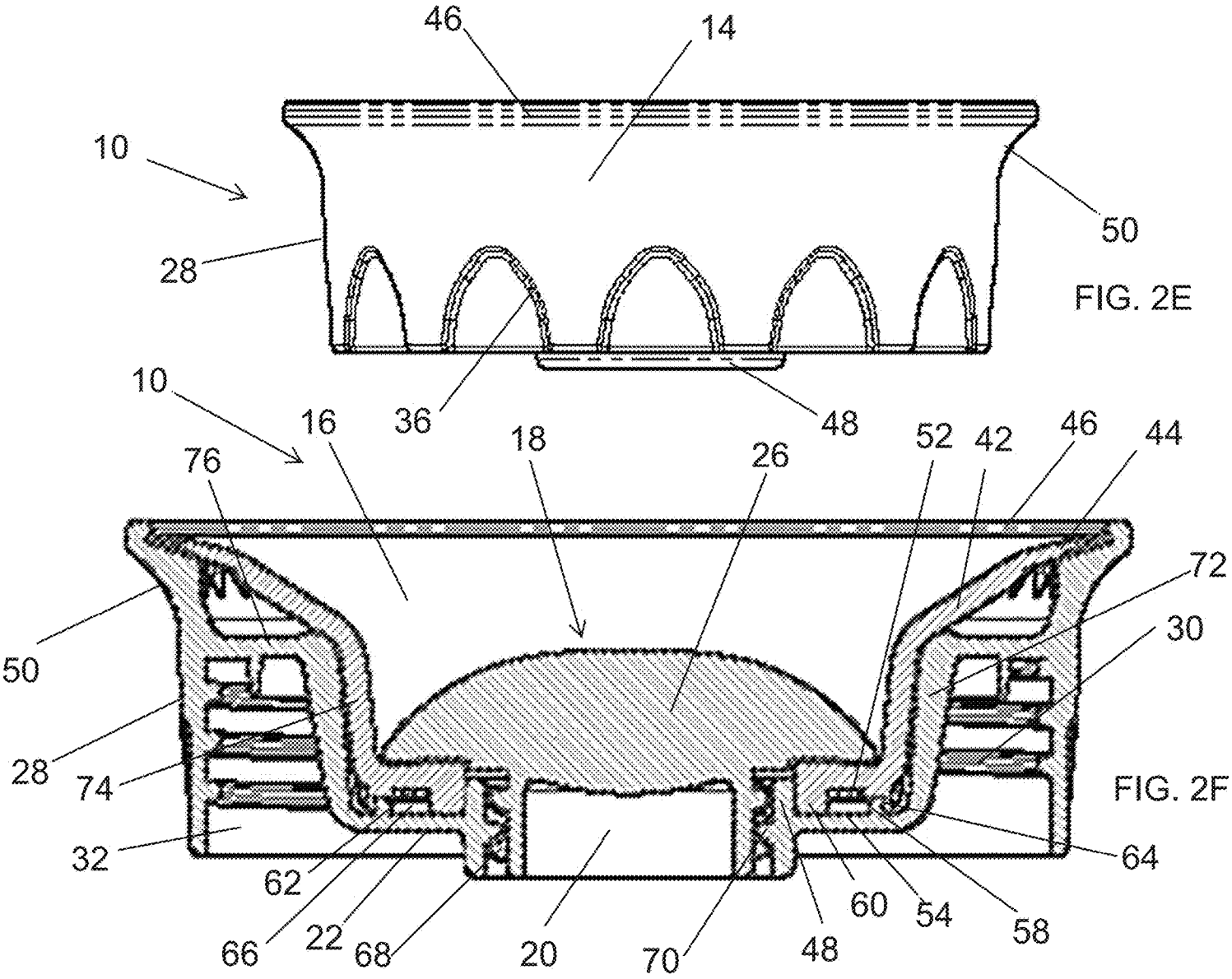
FIG. 2E is a side elevation view of an embodiment of the assembled components of the lid device of the present invention.
FIG. 2F is a cross-sectional view of an embodiment of the assembled components of the lid device of the present invention.

As shown in a side elevation view of the assembly of the lid device 10 in FIG. 2E, in some embodiments the collar 14 may be the only component visible with the cylindrical wall 48 forming the opening in the collar 14 for the attachment of the twist fastener 18 extending a short distance beyond the outer cylindrical wall 28. Alternatively, the body 20 of the twist fastener 18 may extend a short distance beyond the cylindrical wall 48 of the interior cylinder 24 of the collar 14. The outer wall 28 of the collar 14 extends vertically or at a slight angle that then forms a smooth curvature 50 outwards and then rounds to form the rim 46. The cross-sectional view in FIG. 2F shows the outer sealing surface 52 formed at the lower outer surface of the bottom portion of the sealing element 16 seated within a recess 54 formed between the threaded cylindrical wall 48 that forms the central opening in the collar 14 and the interior cylindrical wall 72 that forms the interior cylinder 24. A cylindrical ridge 58 extends from the base 22 of the interior cylinder 24. The cylindrical ridge 58 extends a shorter distance from the base 22 and is therefore shorter in length than the threaded cylindrical wall 48. An interior sidewall 60 depends from the outer sealing surface 52 and a series of teeth or castellations 62 are formed on the sealing surface 52 along an outer sidewall 64 of the mid-section 40. The outer sidewall 64 of the sealing element 16 extends beyond the outer surface of the ridge 58 providing for the castellations 62 to be seated across the ridge 58. The series of castellations 62 form fluid flow paths that extend over the ridge 58 to provide fluid flow from the container 12 when suction is applied to the rim 46 of the lid device 10. When suction is not applied the castellations 62 form capillary seals trapping fluid between each castellation to seal the fluid flow paths and prevent leaking even when the container is tipped or shaken. The castellations 62 provide the capillary sealing because of very short distances with spacing between each castellation in an approximate range of between 0.5 mm (0.019 in.) and 3 mm (0.118 in.) and more preferably at around 1.5 mm (0.059 in.) to seal the fluid flow paths with small bubbles of fluid when suction is not applied. The interior sidewall 60 of the sealing element 16 sets the amount of compression provided by the twist fastener 18 to the sealing element 16 when tightened and because the interior sidewall 60 extends a longer distance than the length of the castellations 62 and longer than the outer sidewall 64, the fluid pathways between the castellations 62 are maintained. The extension of the outer sidewall 64 beyond the ridge 58 supports and aligns the sealing element 16 on the ridge 58 and aligns a channel 66 that is formed in the sealing element 16 between the interior wall 60 and the outer sidewall 64 with the apertures 38 in the base 22 of the collar 14.

As shown in FIG. 2F, the twist fastener 18 has external threads 68 that align and interlock with internal threads formed in the cylindrical wall 48 of the collar 14. Because the sealing element 16 is of a thin, elastic material only one or two threads 68 are needed to attach the twist fastener 18 to the collar 14 and secure the sealing element 16 with the interior wall 60 of the sealing element 16 restricting the amount of compression that can be applied to the sealing element 16 to prevent deformation of the sealing element 16 when tightening the twist fastener 18. The sealing element 16 is shown within the rim 46 and seated within the recess 54 along the base 22 by the interior cylindrical wall 72 of the interior cylinder 24 and the threaded cylindrical wall 48 of the collar 14. The interior cylindrical wall 72 of the interior cylinder 24 extends upwards from the base 22. The cylindrical sidewall 74 of the mid-section 40 of the sealing element 16 is similar in diameter and shape complimenting and aligning the sealing element 16 along the interior cylindrical wall 72 of the interior cylinder 24. At the top of the interior cylindrical wall 72 of the collar 14, a cylindrical shelf 76 is formed creating a reservoir for fluid below the upper conical portion 42 of the sealing element 16 providing a steady flow of fluid from the container 12 when suction is applied to the rim 46 and outer conical flange 44. The shelf 76 offsets the interior cylindrical wall 72 of the interior cylinder 24 from the outer cylindrical wall 28.

Figure 3C:
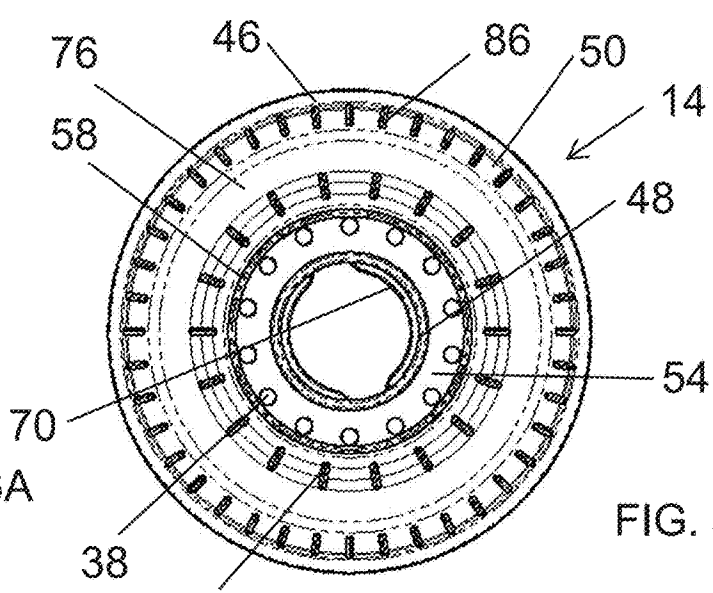
FIG. 3C is a top view of an embodiment of the collar of the lid device of the present invention.
Figure 3D:
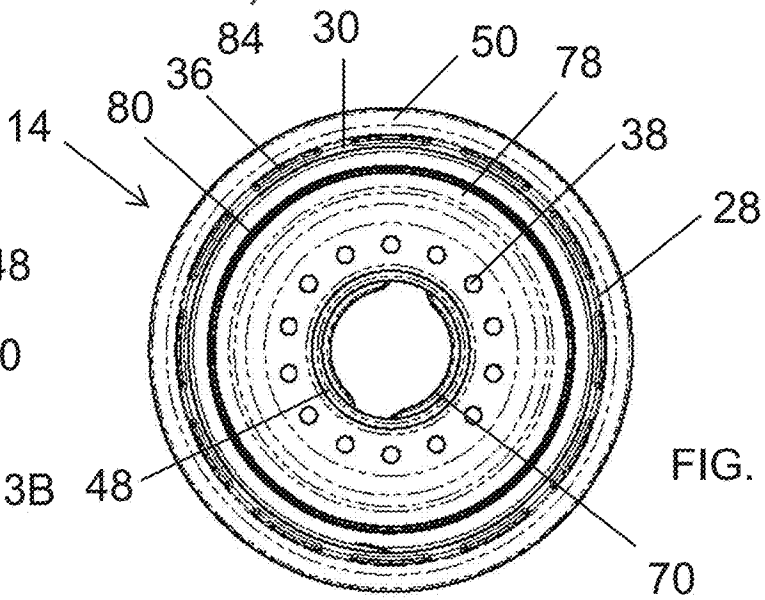
FIG. 3D is a bottom view of an embodiment of the collar of the lid device of the present invention.
Figure 3A:
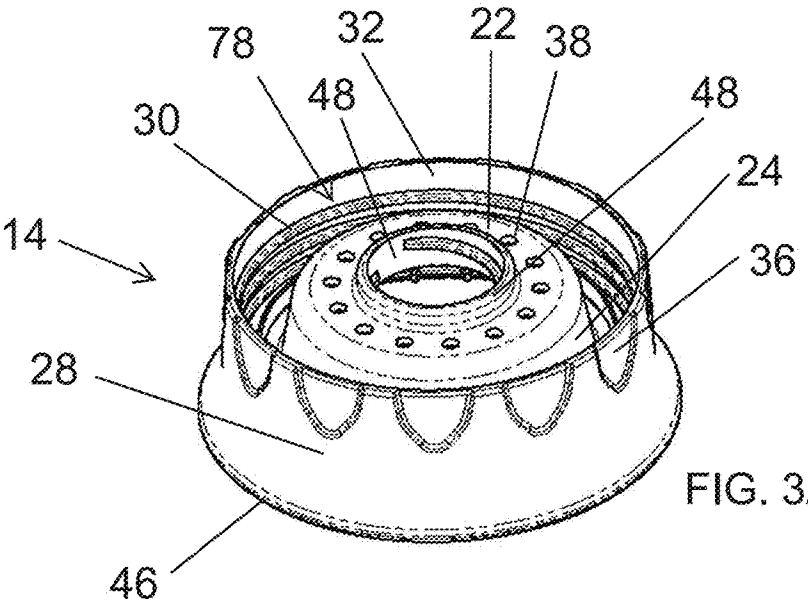
FIG. 3A is a bottom perspective view of an embodiment of the collar of the lid device of the present invention.

The cross-sectional view in FIG. 2F shows the curvature 50 along the outer cylindrical wall 28 and interior threads 30 along the interior surface 32 of the cylindrical wall 28. As shown in a bottom perspective view in FIG. 3A and in a bottom view in FIG. 3D of the collar 14, a channel 78 is formed between the interior cylindrical wall 72 of the interior cylinder 24 and the interior surface 32 that provides for the insertion of the upper edge of a container 12 into the channel 78 to have the collar 14 once tightened using the interior threads 30 be supported and sealed against the edge of the container 12 preventing fluid flow between the interior surface 32 of the collar 14 and the container 12. As shown in FIG. 3D a sealing edge 80 is also provided on the collar 14 to seal against the edge of the container removing the need for a gasket within the channel 78 of the collar 14.

Figure 3B:
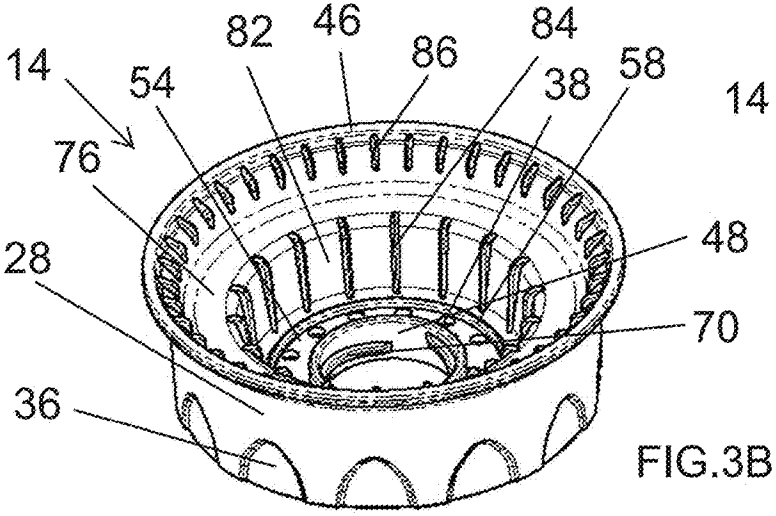
FIG. 3B is a top perspective view of an embodiment of the collar of the lid device of the present invention.

As shown in FIG. 3B the interior surfaces 82 of the interior cylindrical wall 72 of the interior cylinder 24 have a series of protrusions 84 that form fluid channels. The protrusions 84 support the mid-section 40 of the sealing element 16 and when suction is applied the sealing element 16 deforms and separates from the interior cylindrical wall 72 providing for fluid to flow between the protrusions 84. The sealing element 16 is seated within the recess 54 and supported on the ridge 58 creating a pathway for fluid flow through the apertures 38, through the fluid flow pathways formed in the teeth or castellations 62 and out and along the interior surfaces 82 of the interior cylindrical wall 72 of the interior cylinder 24. The cylindrical shelf 76 provides a reservoir and outer protrusions 86 along the curvature of the rim 46 provide fluid channels between the outer conical flange 44 and the rim 46. The internal threads 70 that provide for the attachment of the twist fastener 18 are also shown aligned along the cylindrical wall 48 forming the opening in the collar 14. The opening is circular and the threads 70 extend along a portion of the cylindrical wall 48 as shown in a top view of the collar in FIG. 3C.

Figure 3E:
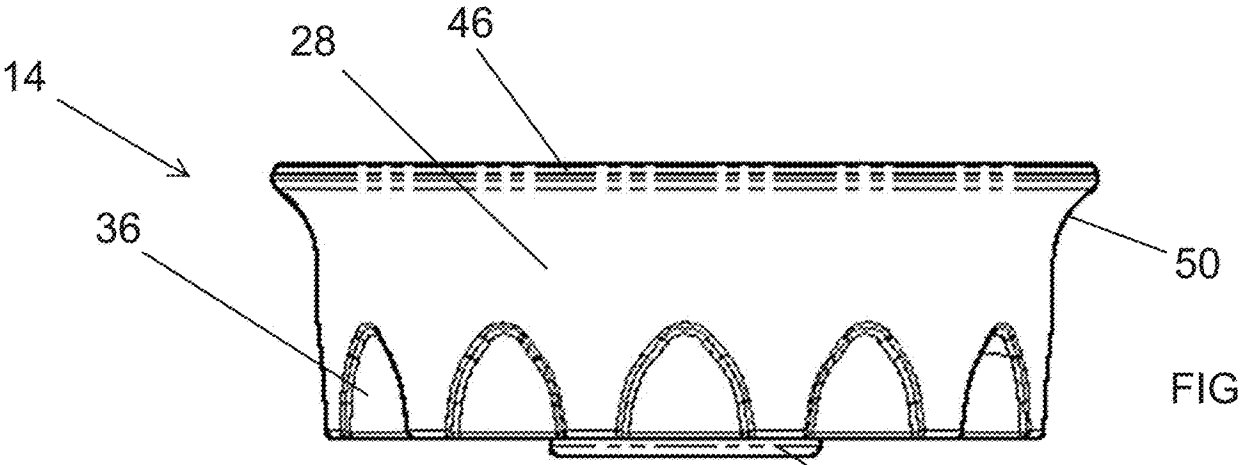
FIG. 3E is a side elevation view of an embodiment of the collar of the lid device of the present invention.

As shown in a side elevation view of the collar 14 in FIG. 3E, the threaded cylindrical wall 48 forming the opening in the collar 14 for the attachment of the twist fastener 18 may extend a short distance beyond the outer cylindrical wall 28. The outer cylindrical wall 28 of the collar 14 may extend vertically or at a slight angle that then may be formed as a smooth curvature 50 outwards that then rounds to form the rim 46. Grips, indentations or other surface texture 36 may be formed in the outer cylindrical wall 28 to provide for a person to more easily grab or hold the collar 14 particularly when threading and turning the collar 14 for attachment to a container 12.

Figure 3F:
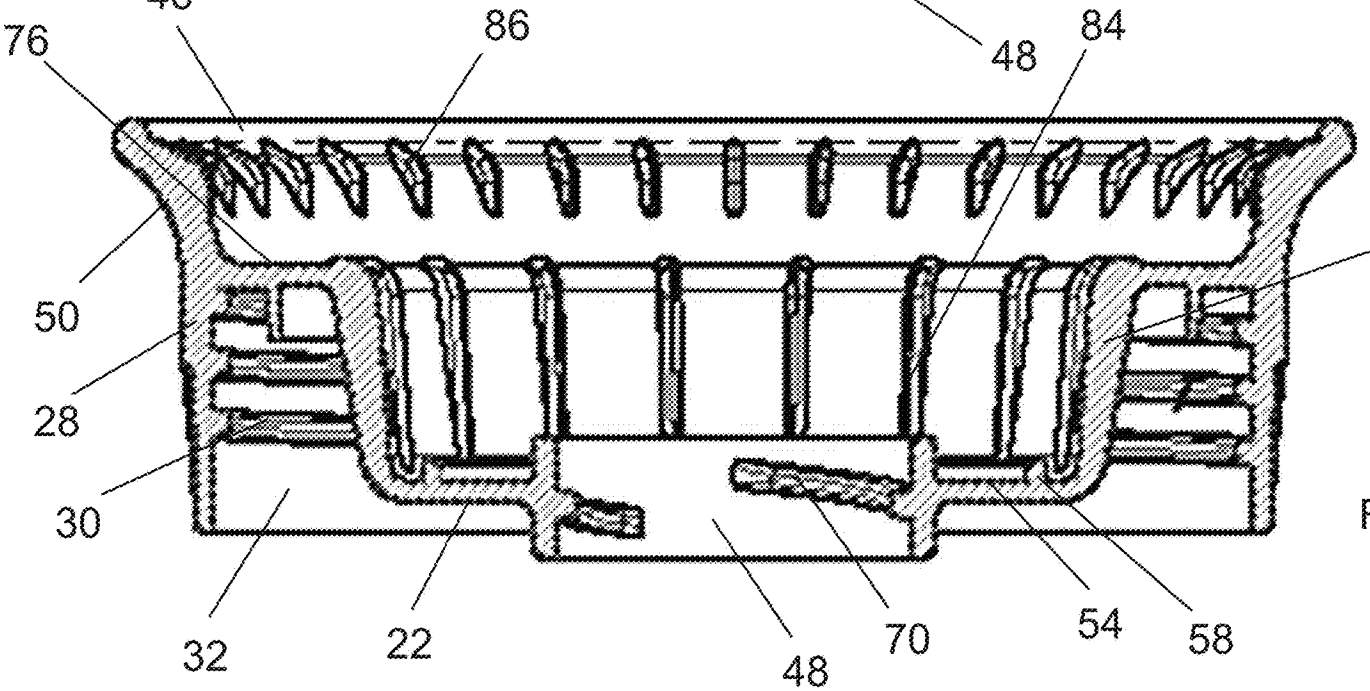
FIG. 3F is a cross-sectional view of an embodiment of the collar of the lid device of the present invention.

As shown in the cross-sectional view in FIG. 3F, the protrusions 84 may be evenly spaced and protrude only a short distance from the interior surface 82 of the interior cylindrical wall 72 of the interior cylinder 24. The upper protrusions 86 may extend as angular points along the upper interior curved surface 50 of the rim 46 providing support and surface contact to the conical flange 44 of the sealing element 16. The interior threads 30 on the interior surface 32 provide for attachment of the collar 14 to a container 12. Alternatively, embodiments of the collar 14 may be provided with external threads along the outer cylindrical wall 28 for attachment to a container having internal threads. The threads 70 extend along a portion of the cylindrical wall 48 that forms the opening through the collar 14.

Figure 4B:
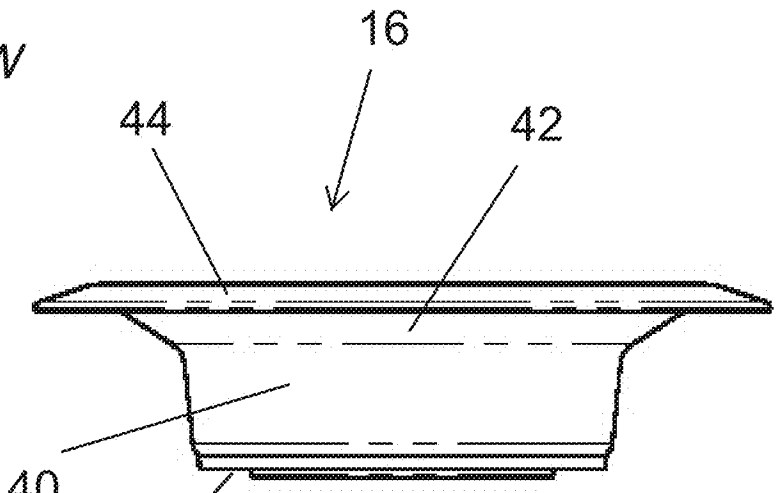
FIG. 4B is a side elevation view of an embodiment of the sealing element of the lid device of the present invention.
Figure 4A:
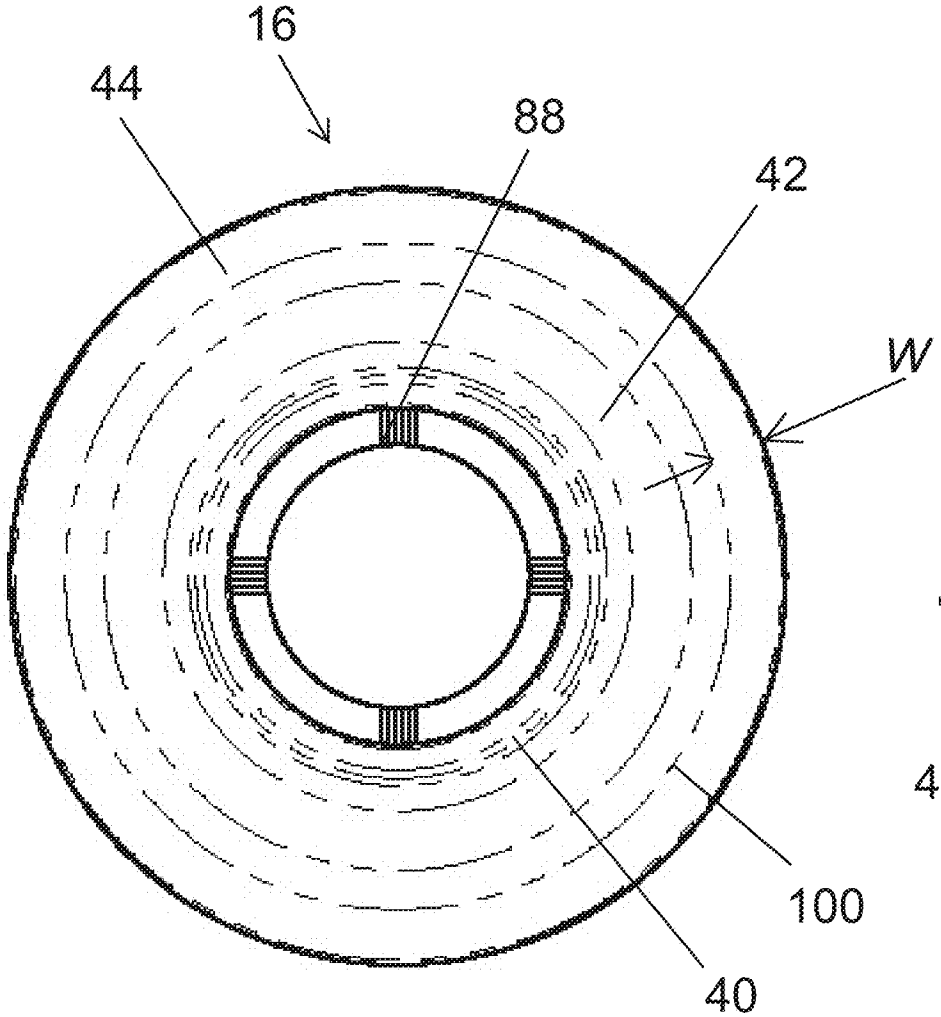
FIG. 4A is a top view of an embodiment of the sealing element of the lid device of the present invention.

As shown in FIG. 4A, in some embodiments, the sealing element 16 may be provided with one or more air vents 88 to provide air flow to the container 12 when suction is applied to the lid device 10. In some embodiments, if air vents 88 are provided, there are preferably more air vents 88 on one side of the sealing element 16 than on the other side of the sealing element 16 to provide for increased fluid flow. If suction is applied to the rim 46 and conical flange 44 along the opposite side of the sealing element 16 having more air vents 88 more fluid will flow from the container 12 than if suction is applied to the rim 46 and conical flange 44 along the opposite side of the sealing element 16 having less air vents 88. Therefore, for a person that prefers less fluid flow, they may choose to apply suction to the lid device 10 opposite the side with less air vents 88. However, air vents 88 are not required in all embodiments.

Figure 4C:
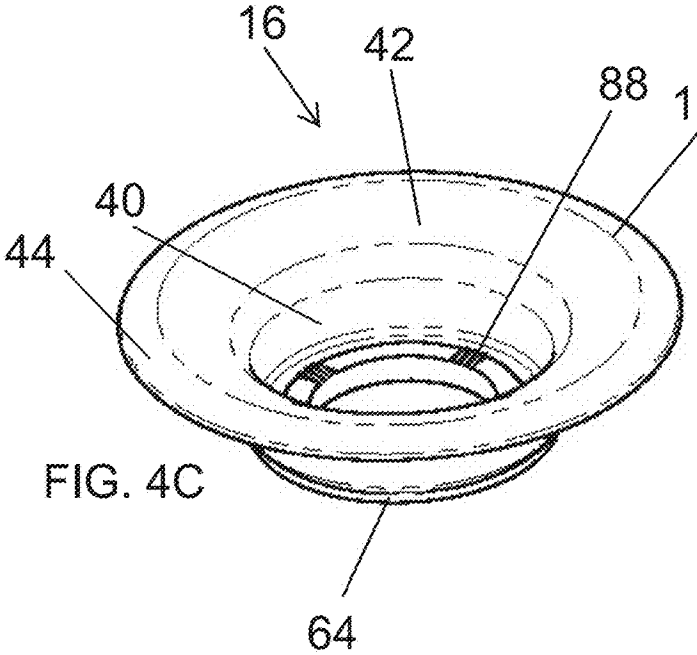
FIG. 4C is a top perspective view of an embodiment of the sealing element of the lid device of the present invention.

As shown in FIG. 4B, the sealing element 16 is formed without channels or fluid pathways and instead has smooth surfaces and transitions to remove areas where dirt and germs may collect making cleaning of the sealing element 16 much more effective. An upper perspective view is shown in FIG. 4C showing the smooth transitions along the upper surface of the sealing element 16 where the upper conical flange 42 extends up and outwards from the cylindrically shaped mid-section 40. The outer cylindrical sidewall 64 has a smooth surface to be seated and align along the interior cylindrical wall 72 of the interior cylinder 24 of the collar 14. The outer conical flange 44 extends out and downward at a slight angle from the upper conical flange 42 forming a transition point 100 that provides for the deformation of the sealing element 16 when compressed along and in the region of this transition point 100.

Figure 4E:
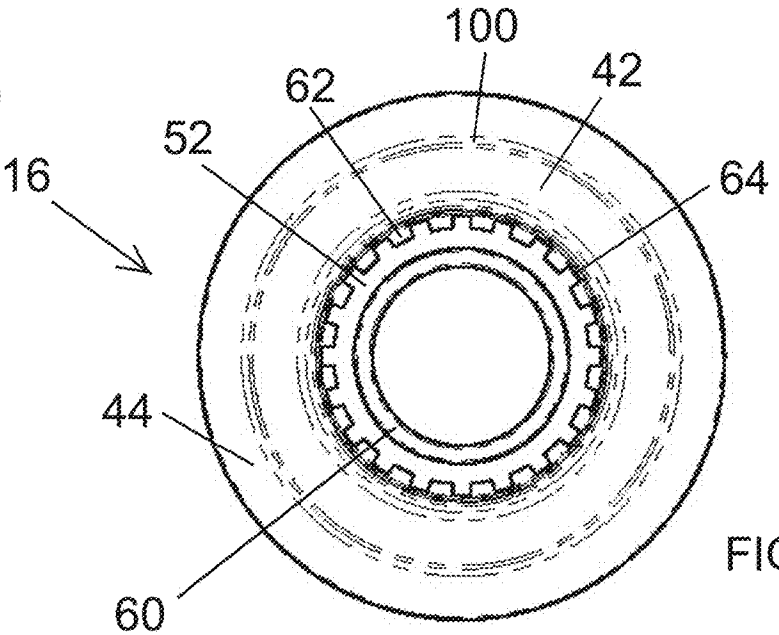
FIG. 4E is a bottom view of an embodiment of the sealing element of the lid device of the present invention.
Figure 4D:
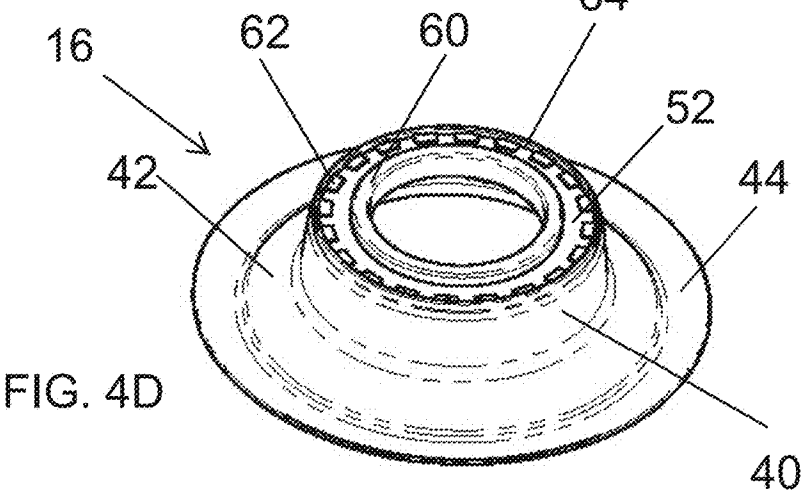
FIG. 4D is a bottom perspective view of an embodiment of the sealing element of the lid device of the present invention.
Figure 4F:
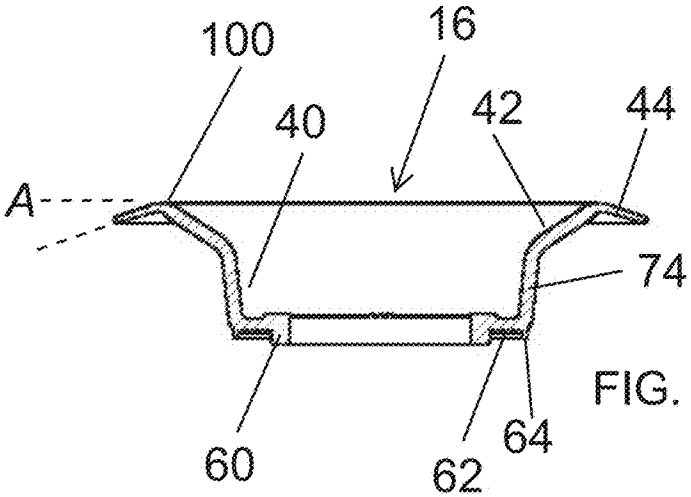
FIG. 4F is a cross-sectional view of an embodiment of the sealing element of the lid device of the present invention.

As shown in FIG. 4D, the interior sidewall 60 extends beyond the outer sealing surface 52 and a series of teeth or castellations 62 are formed on the sealing surface 52 along the outer sidewall 64 of the mid-section 40. The interior sidewall 60 is thicker and more rigid than the outer sealing surface 52 and by extending the interior sidewall 60 the amount of compression of the twist fastener 18 is set by the rigidity of the interior sidewall 60. This added rigidity maintains the fluid flow paths through the castellations 62 when the twist fastener 18 is tightened. The fluid flow paths formed by the series of castellations 62 are dimensionally very small with the spacing between each castellation being in an approximate range of between 0.5 mm (0.019 in.) and 3 mm (0.118 in.) and more preferably at 1.5 mm (0.059 in.). When suction is applied to the rim 46 and conical flange 44 of the lid device 10, fluid from the container is drawn through the fluid flow paths formed by the teeth or castellations 62, shown in a bottom view of the sealing element 16 in FIG. 4E. When suction stops and is not applied the castellations 62 form capillary seals trapping fluid between each castellation to seal the fluid flow paths and prevent leaking even when the container is tipped or shaken. As shown in FIG. 4F, the outer sidewall 64 is shorter than the interior sidewall 60 and serves to align the castellations 62 on the ridge 58 that extends from the base 22 of the collar 14. The cross-sectional view in FIG. 4F also shows that the conical flange 44 is thinner than the upper cylindrical section 42 providing for greater deformation along the conical flange 44 when suction is applied by mouth. The conical flange 44 extends at an angle downwards from the upper cylindrical section 42 forming a transition point 100 at the angle formed and providing for compression of the sealing element 16. When the transition point 100 is compressed the outer flange 44 is forced up and away from the rim 46 of the collar 14. The transition point 100 therefore acts as a lever and creates a pivot point for the conical flange 44 to rotate about and thereby provide for more fluid flow from a container 12 when suction is applied than from lid devices of the prior art that do not provide a downwards angle and may use only suction to draw out the fluid contents from the container 12.

Figures 5A, 5B, 5C, 5D, 5E, 5F, 5G, 5H:
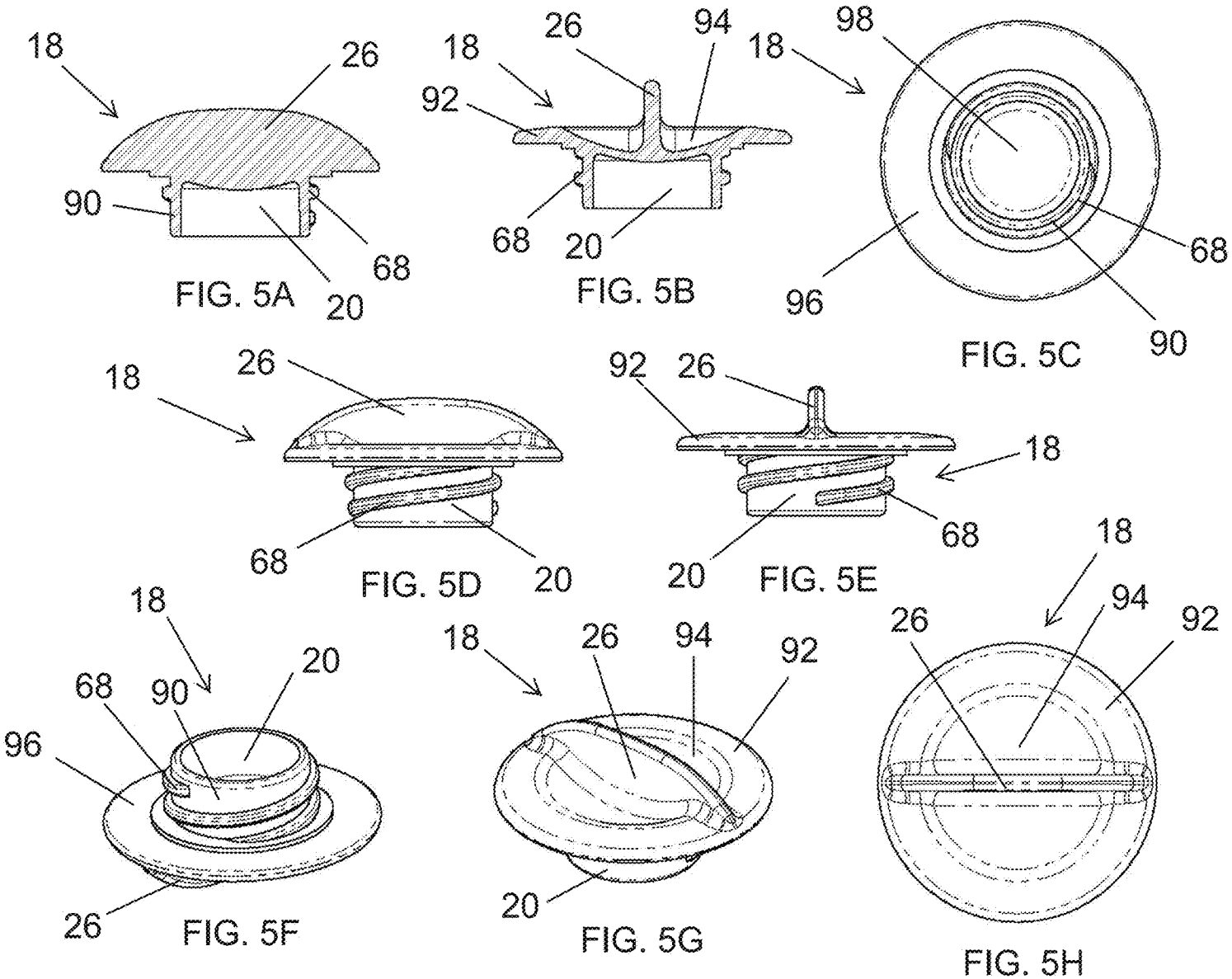
FIG. 5A is a cross-sectional view of the side elevation view shown in FIG. 5D in an embodiment of the twist fastener of the lid device of the present invention.
FIG. 5B is a cross-sectional view of the side elevation view shown in FIG. 5E in an embodiment of the twist fastener of the lid device of the present invention.
FIG. 5C is a bottom view of an embodiment of the twist fastener of the lid device of the present invention.
FIG. 5D is a side elevation view showing the tab in an embodiment of the twist fastener of the lid device of the present invention.
FIG. 5E is a side elevational view perpendicular to the tab in an embodiment of the twist fastener of the lid device of the present invention.
FIG. 5F is a bottom perspective view of an embodiment of the twist fastener of the lid device of the present invention.
FIG. 5G is a top perspective view of an embodiment of the twist fastener of the lid device of the present invention.
FIG. 5H is a top view of an embodiment of the twist fastener of the lid device of the present invention.

A cross-sectional view of the twist fastener 18 is shown in FIG. 5A. The twist fastener 18 may be formed of a rigid material with a hollow body 20 that has threads 68 along its exterior wall 90. A tab 26 is formed in the upper portion that may be semi-circular in shape or be of any suitable shape to provide for a person to grip and turn the twist fastener 18 to attach or remove the twist fastener 18 from the collar 14. As shown in a cross-sectional view in FIG. 5B that has turned the twist fastener 18 to show the tab 26 perpendicular to the view in FIG. 5A, the twist fastener 18 is formed with a flange 92 that extends out from the body 20 and the tab 26 extends up in the center of the flange 92. An indent 94 may be provided on either side of the flange 92 to provide more surface area for the tab 26 to make it easier for the fingers of a person to grasp and turn. A bottom view of the twist fastener 18 is shown in FIG. 5C showing a flat lower surface 96 of the flange 92 that will compress against the sealing element 16 to secure it to the collar 14 and an interior surface 98 formed within the cylindrical exterior wall 90. The interior surface 98 may have a slight curvature from the indent 94 formed in the upper surface. A side elevation view of the twist fastener 18 showing the semi-circular shape of the tab 26 in this embodiment is shown in FIG. 5D and a side view perpendicular to the tab 26 showing the extension of the flange 92 is shown in FIG. 5E. As shown in FIG. 5F, in some embodiments, only a couple of threads 68 are necessary to attach the twist fastener 18 to the collar 14 and secure the sealing element 16 providing for the twist fastener 18 to be turned only through a short revolution making the twist fastener 18 easier to attach and remove from the collar 14, particularly handy when contents must be added to the container 12. The collar 14 may remain attached to the container 12 and sealing element 16 may remain in the collar 14 when the twist fastener 18 is removed. The contents may be poured through the openings in the sealing element 16 and collar 14 to be placed in or added to the contents of the container 12 and the twist fastener 18 may be reattached to the collar 14, preventing a risk of damage or deformation to the sealing element 16 in removing it from the collar 14. The indent 94 to more easily grasp the tab 26 is shown in FIG. 5G and a top view in FIG. 5H shows the central positioning of the tab 26 to make it easily accessible when it is attached and surrounded by the mid-section 40 of the sealing element 16.

Figure 6B:
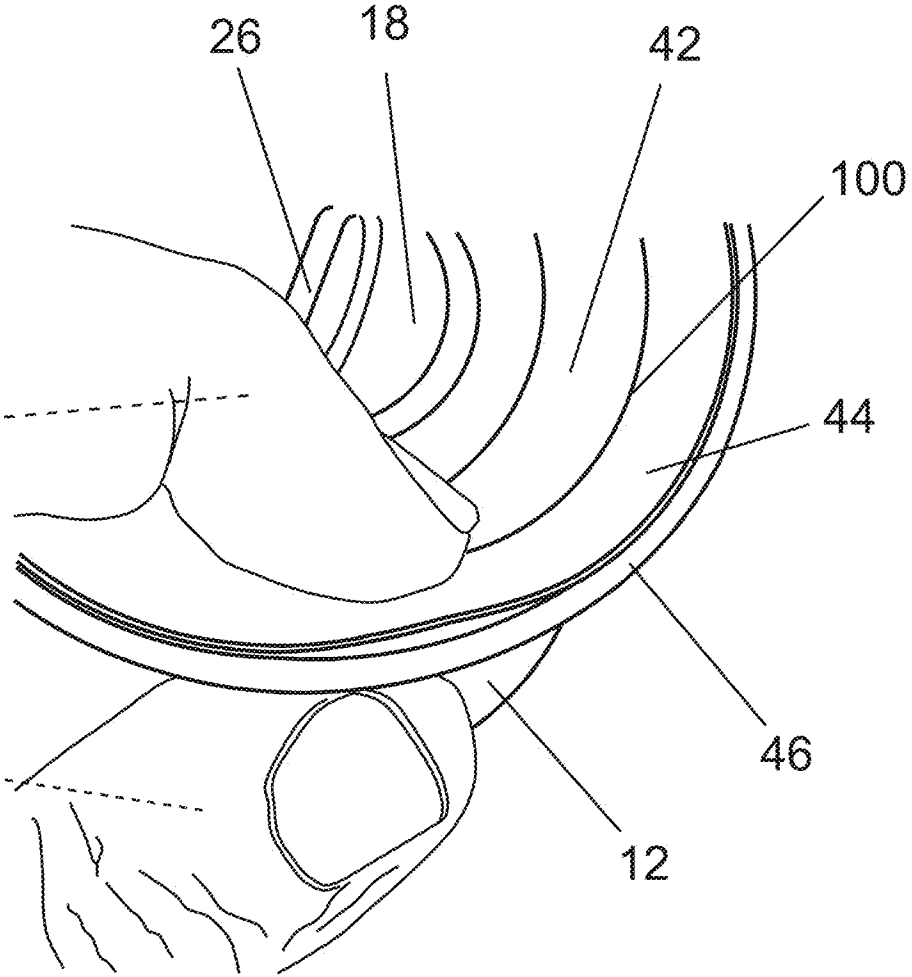
FIG. 6B is a perspective view of an embodiment of the lid device and container of the present invention showing the much wider opening of the sealing element when the sealing element is compressed.
Figure 6A:
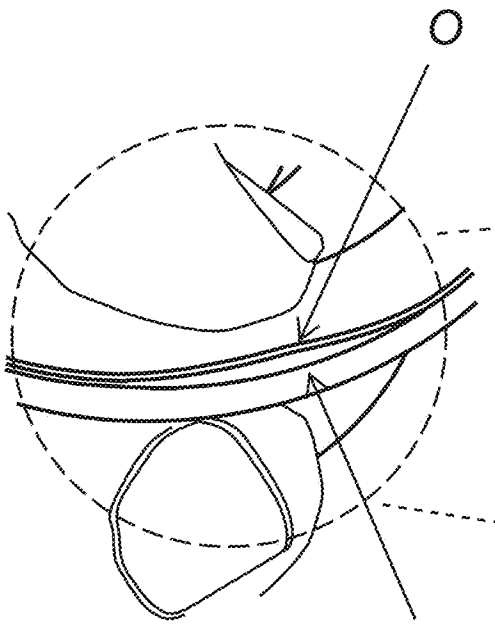
FIG. 6A is an inset of an embodiment of the lid device of the present invention showing the much wider opening of the sealing element when the sealing element is compressed.

As shown in the inset in FIG. 6A, an important feature of the sealing element 16 of the lid device 10 is the outer conical flange 44 that includes the unique transition point 100 located around the upper and lower surface of the sealing element 16. The transition point 100 is where in some embodiments the thickness of the sealing element 16 transitions from the thicker upper conical portion 42 to the thinner outer conical flange 44 and where in some embodiments, the conical flange 44 is angled out and downwards from the upper conical portion 42. Along the lower outer surface of the sealing element 16, the upper conical portion 42 is of one thickness and then a sharp transition is formed at the transition point 100 to a second thickness of the conical flange 44 that is thinner than the upper conical portion 42, as shown in the cross-sectional view in FIG. 4F. The sealing element 16 is formed from a single type of safe, non-toxic material and molded to have a consistent thickness along the bottom portion, mid-section 40, and along the upper conical portion. The thicker material portions of the sealing element 16 provide rigidity and resilience and allow for repeated bending without permanent deformation as the sealing element 16 is placed in and removed from the recess 54 of the collar 14. The outer conical flange 44 while thinner is of the same resilient material so is more easily deformed and provides for repeated compression by the lip of a person without permanent deformation.

As shown in FIG. 4A in a top view of the sealing element 16, the width W of the outer conical flange 44 is in a range between 0.32 cm (0.125 in) and 1.27 cm (0.50 in) and preferably at approximately 0.64 cm (0.25 in) providing for a person's lip to extend over the conical flange 44 and rest along the transition point 100. As shown in the cross-sectional view in FIG. 4F, the upper surface of the sealing element 16 is smooth and at the transition point angles slightly downwards from the upper conical portion 42 to the conical flange 44 forming an acute angle A downwards from the horizontal along the top of the upper conical portion 42 of between 5 degrees and 30 degrees and more preferably at approximately 15 degrees.

The transition point 100 along the upper surface of the sealing element 16 is therefore a slightly raised angular transition that the lip reaches to and can rest on and then compress at the distance of the width W of the conical flange 44. The compression of the lip at the transition point 100 allows for the conical flange 44 to flex up and pull away from the rim 46 of the collar 14 and open wider than the opening that would be formed by only applying suction to the sealing element 16. The sharp transition of thicker material to thinner material at the transition point 100 along the bottom surface of the sealing element 16 as shown in FIG. 4D provides more resilience up to the transition point 100 and then resilience with flexing beyond the transition point 100 allowing the outer conical flange 44 to be flexible and open wide while the mid-section 40 and upper conical portion 42 resist deformation thereby maintaining fluid flow through the fluid flow paths formed by the protrusions 84 along the interior cylinder 24 of the collar 14. The angle A at the transition point 100 also prevents compression at the upper conical portion 42 and along the cylindrical shelf 76 of the collar 14 so that fluid may be held within the reservoir formed by the shelf 76 to maintain a constant fluid flow when suction is applied.

Figure 7B:
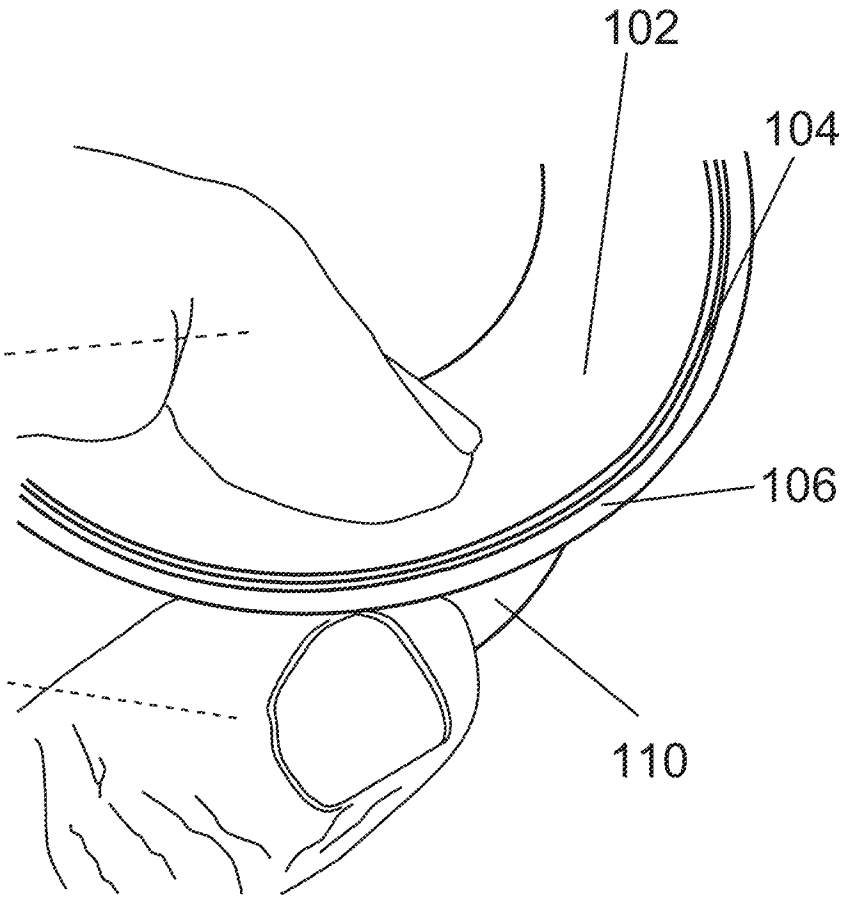
FIG. 7B (PRIOR ART)
FIG. 7B is a perspective view of the prior art showing no opening of the sealing element when the sealing element is compressed, the sealing element of the prior art only opening when suction is applied.
Figure 7A:
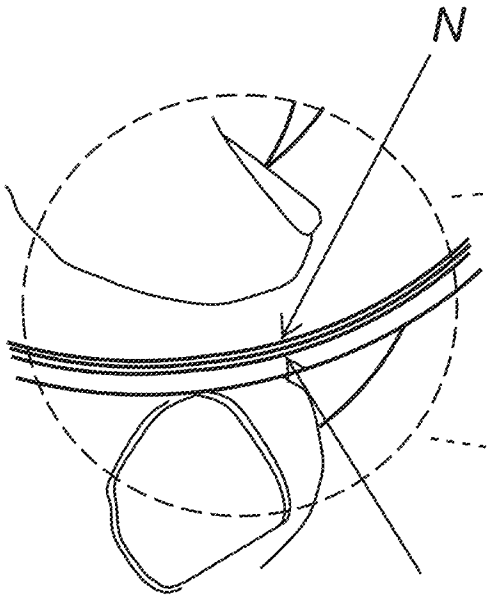
FIG. 7A (PRIOR ART)
FIG. 7A is an inset of a lid device of the prior art showing no opening of the sealing element when the sealing element is compressed, the sealing element of the prior art only opening when suction is applied.

Therefore, when the sealing element 16 is compressed along the transition point 100 as shown in FIG. 6B, the opening O that is formed is much wider than an opening that can be formed by suction alone and provides for much more fluid flow with less exertion by a person than the lid devices of the prior art. As shown in the inset in FIG. 7A, the lid devices of the prior art do not form an opening when compressed, but only open when suction is applied. Most lid devices of the prior art provide a sealing element or gasket 102 with a consistent thickness of material from a central portion to the edge 104 of the sealing element 102 that meets along the rim 106 of a collar or container 110 as shown in FIG. 7B. When compressed the sealing element 102 does not open along the edge 104 and rim 106 as indicated by the point N but only opens when suction is applied by a person. The downward angle of the outer flange 44 of the lid device 10 of the present invention readily flexes when compressed and provides a much wider opening when suction is applied providing a greater amount of fluid over a given period than the lid devices of the prior art. This unique feature of the present invention provides for the desired amount of fluid flow from the container by applying suction and by adjusting the amount of compression using the lip with the amount of compression increasing or decreasing the width of the opening O and the amount of fluid flow. The sealing element 16 with the outer conical flange 44 therefore provides more fluid flow with much less exertion of energy by a person in applying suction to draw fluid than the lid devices of the prior art.

Figure 8B:
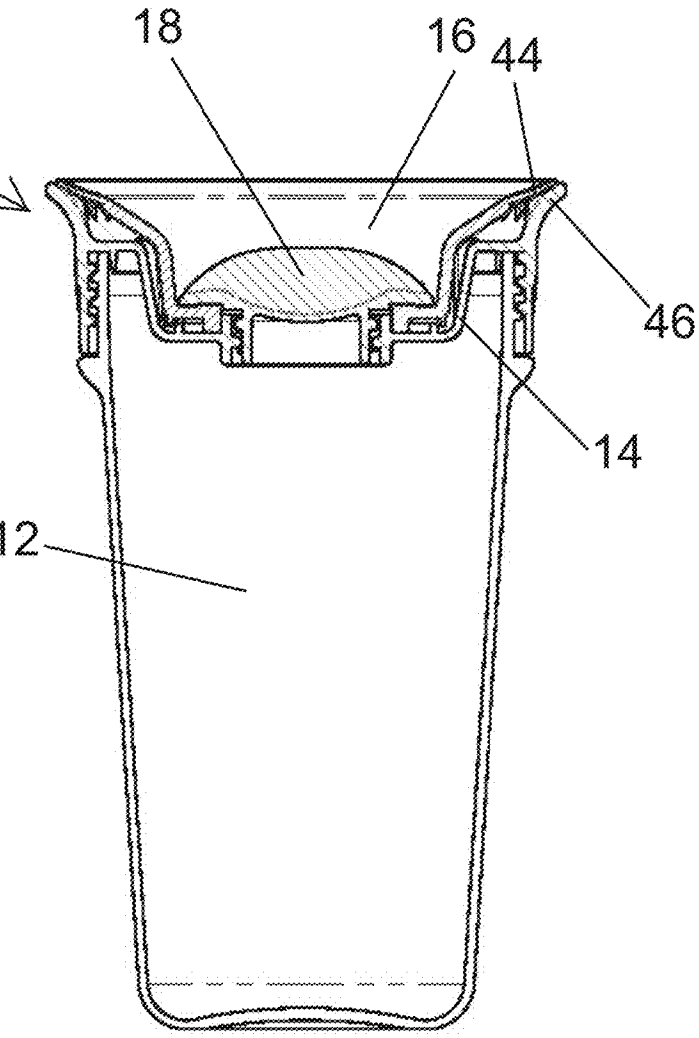
FIG. 8B is a cross-sectional view of an embodiment of the lid device of the present invention with a container.
Figure 8A:
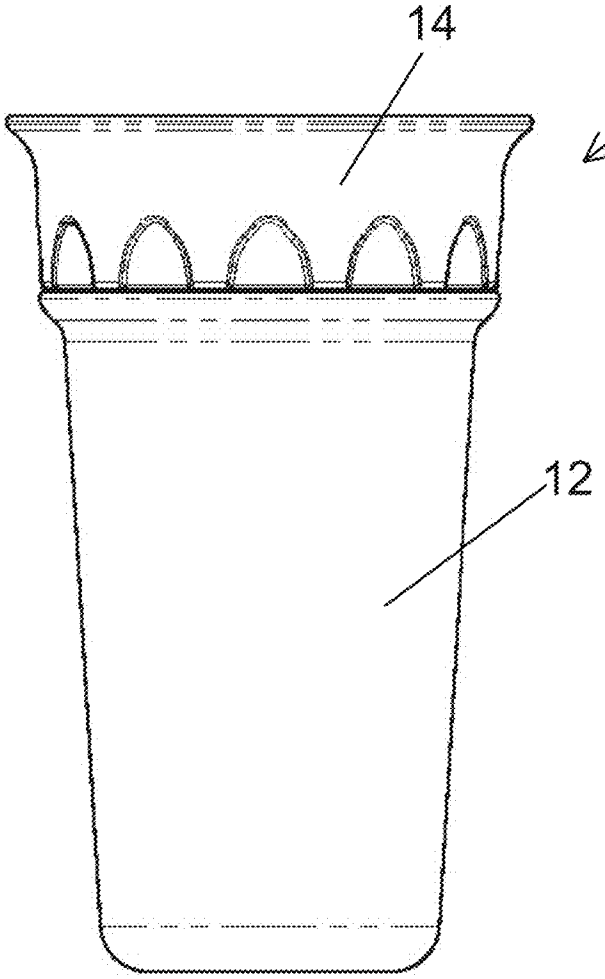
FIG. 8A is a side elevation view of an embodiment of the lid device of the present invention with a container.
Figure 8D:
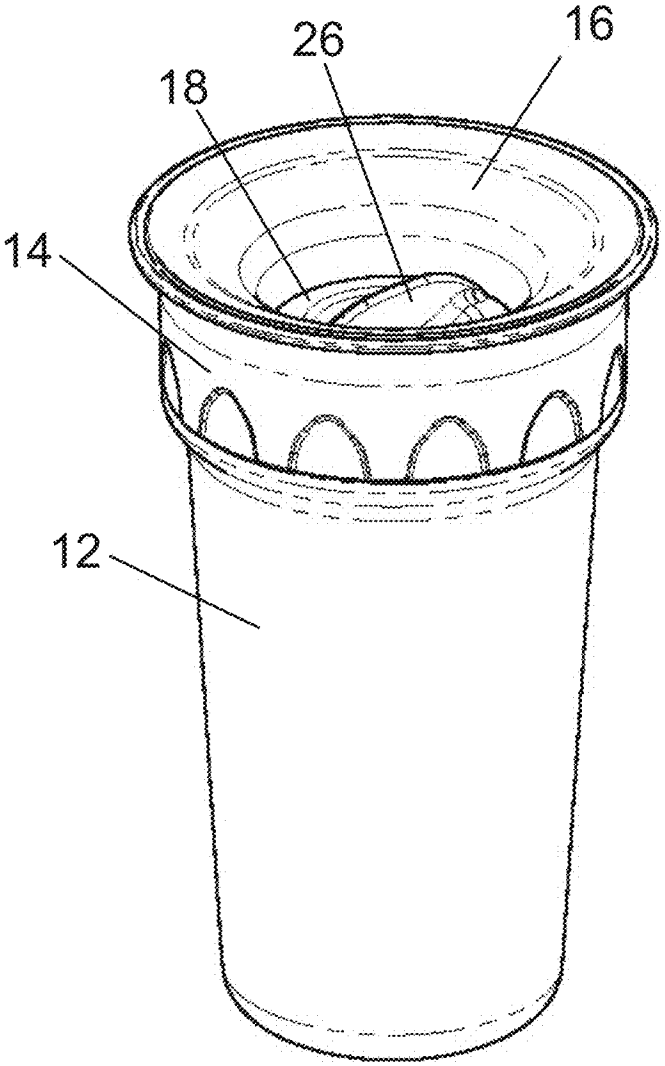
FIG. 8D is a top perspective view of an embodiment of the lid device of the present invention with a container.
Figure 8C:
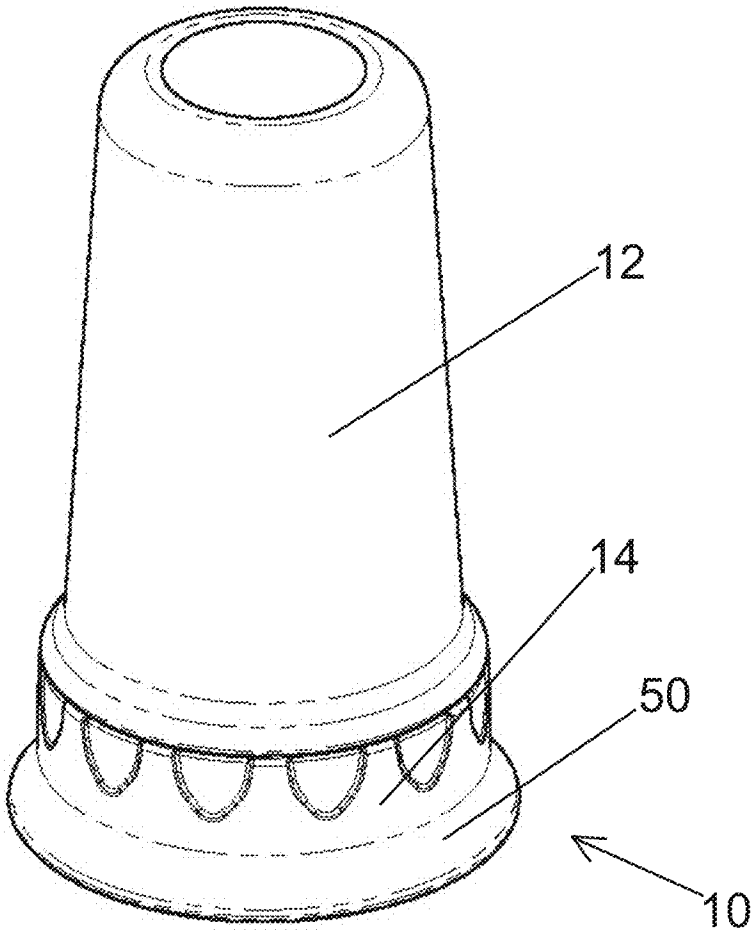
FIG. 8C is a bottom perspective view of an embodiment of the lid device of the present invention with a container.

As shown in FIG. 8A, the lid device 10 of the present invention is attached to any type of container with the collar 14 having internal or external standard thread sizes that are used within the industry for non-spill drinking cups and travel mugs. As shown in FIG. 8B, in embodiments of the lid device 10, the outer conical flange 44 of the sealing element 16 mates along and is within the rim 46 of the collar 14 preventing pulling up on or deforming the outer conical flange 44 of the sealing element 16 when moving or storing the lid device 10 and container 12. As shown in FIG. 8C, when installed the container 12 with lid device 10 may be turned upside down, tilted or shaken and the contents within the container 12 are sealed and will not leak due to the capillary action of the teeth 62 that prevent fluid flow when suction is not applied. The collar 14 also provides a smooth ergonomic curvature 50 to allow for the mouth of a person to surround the rim 46 and outer conical flange 44 of the lid device 10 and compress and apply suction to the sealing element 16 to drink from the container 12. The tab 26 of the twist fastener 18 may be turned to remove the twist fastener 18 without removing or deforming the sealing element 16 to add contents to the container 12 such as a powder like a baby or protein formula. The twist fastener 18 is reinstalled as shown in FIG. 8D and the container 12 may be shaken to mix the contents without spilling from the container 12. The lid device 10 of the present invention provides unique teeth or castellations 62 that seal the contents of the container 12 without springs, hinges, or valves that may have difficult to clean surfaces. The lid device 10 of the present invention further provides a unique downwards angle of the sealing element 16 with a transition in thickness to provide more fluid flow with less exertion by a person in drinking from the container 12.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed:

1. A non-spill lid device for a drinking container, comprising:

a collar, the collar having a base with a ridge extending from the base;

a sealing element comprising:

a bottom portion forming an outer sealing surface;

an outer sidewall extending from the outer sealing surface in a first direction;

castellations positioned along the outer sidewall and extending from the outer sealing surface in the first direction, the castellations forming fluid flow paths;

a rigid interior sidewall extending from the outer sealing surface in the first direction a distance that is longer than a length of the castellations and a length of the outer sidewall;

a cylindrical mid-section extending from the bottom portion;

an upper conical portion extending from the cylindrical mid-section; and a conical flange extending from the upper conical portion at an angle that is downwards from a horizontal formed along the top of the upper conical portion; and a twist fastener configured for attachment to the collar to secure the sealing element;

wherein the castellations are configured to be seated across the ridge formed in the base of the collar, the fluid flow paths of the castellations extending over the ridge to provide fluid flow from the container when suction is applied to the lid device;

wherein the amount of compression of the twist fastener is set by the rigid interior sidewall, the rigidity of which maintains the fluid flow paths through the castellations;

the lid device configured to seal a drinking container and prevent spills even when tipped or shaken.

2. The non-spill lid device for a drinking container of claim 1 wherein the collar having a diameter and threads configured to be compatible for attachment of the lid device to drinking containers of various types.

3. The non-spill lid device for a drinking container of claim 1 wherein the twist fastener having a tab that may be easily grasped between the fingers and be turned.

4. The non-spill lid device for a drinking container of claim 1 wherein the twist fastener is configured to be inserted through an opening in the sealing element and an opening in the collar, the twist fastener configured to be removed to add contents to a container without removing or deforming the sealing element or removing the collar of the lid device from the container.

5. The non-spill lid device for a drinking container of claim 1 wherein the collar, sealing element, and twist fastener of the lid device are made from non-toxic materials having exposed surfaces for easy cleaning.

6. The non-spill lid device for a drinking container of claim 1 wherein the collar comprising;

a first cylindrical wall forming an opening in the collar and configured for attachment of the twist fastener;

a second cylindrical wall having a base extending to the first cylindrical wall forming a cylinder having a recess along the base between the first cylindrical wall and the second cylindrical wall, the base having a plurality of apertures for fluid flow from the container.

7. The non-spill lid device for a drinking container of claim 6 wherein the collar comprising;

a third cylindrical wall offset from the cylinder by a shelf formed between the second cylindrical wall and the third cylindrical wall, the third cylindrical wall curving outward to form a rim, the rim having protrusions forming fluid flow channels.

8. The non-spill lid device for a drinking container of claim 1 wherein the sealing element has an outer sealing surface along the bottom of the sealing element configured to be seated within the recess of the collar.

9. The non-spill lid device for a drinking container of claim 8 wherein the castellations of the sealing element forming fluid flow paths at the outer sealing surface, the castellations configured to form capillary seals trapping fluid between each castellation when suction is not applied sealing the fluid flow paths.

10. The non-spill lid device for a drinking container of claim 9 wherein the castellations are formed along an outer sidewall of the outer sealing surface.

11. The non-spill lid device for a drinking container of claim 1 wherein the conical flange formed with a thickness that is thinner than the thickness of the upper conical portion providing for greater deformation along the conical flange.

12. The non-spill lid device for a drinking container of claim 1 wherein the downwards angle forms a transition point between the upper conical portion and the conical flange and thereby the conical flange is configured to flex and separate from the collar when a lip compresses at or near the transition point thereby providing more fluid flow from a container with less exertion of energy in applying suction by a person.

13. The non-spill lid device for a drinking container of claim 1 wherein the collar comprises an interior cylinder configured to align with the cylindrical mid-section of the sealing element, the interior cylinder having protrusions forming fluid flow channels.

14. A method of sealing a drinking container, comprising:

forming a lid device having a collar, a sealing element and a twist fastener;

forming the collar with a base and a ridge extending from the base;

forming the sealing element with an outer sealing surface, the outer sealing surface having castellations that form fluid flow paths;

forming the sealing element with:

a bottom portion forming an outer sealing surface;

an outer sidewall extending from the outer sealing surface in a first direction;

castellations positioned along the outer sidewall and extending from the outer sealing surface in the first direction, the castellations forming fluid flow paths;

a rigid interior sidewall that extends extending from the outer sealing surface in the first direction a longer distance than a length of the castellations and a length of the outer sidewall;

a cylindrical mid-section extending from the bottom portion;

an upper conical portion extending from the cylindrical mid-section; and a conical flange extending from the upper conical portion at an angle that is downwards from a horizontal formed along the top of the upper conical portion; and attaching the twist fastener to the collar to secure the sealing element.

15. The method of sealing a drink container of claim 14, comprising:

forming a recess in the collar, the recess having a cylindrical ridge;

seating the sealing element within the recess with the castellations configured to be seated across the ridge thereby providing for fluid flow when suction is applied and forming capillary seals of the fluid flow paths when suction is not applied.

16. The non-spill lid device for a drinking container of claim 1 wherein the conical flange has a width between 0.125 inches and 0.50 inches.

17. The non-spill lid device for a drinking container of claim 1 wherein the conical flange extends from the upper conical portion at a downward angle of between 5 and 30 degrees.

18. The non-spill lid device for a drinking container of claim 17 wherein the conical flange extends from the upper conical portion at a downward angle of 15 degrees.

19. The non-spill lid device for a drinking container of claim 12 wherein, when assembled, contact between the collar and the sealing element causes the conical flange to extend from the upper conical portion at an angle that is upwards relative to a highest point of the upper conical portion.

* * * * *